United States Patent [19]

Martinez

[11] Patent Number: 4,829,855

[45] Date of Patent: May 16, 1989

[54] MAGNETIC NAIL HOLDING DEVICE

[76] Inventor: Alberto Martinez, Rt. 1, Box 150, Tennessee Colony, Tex. 75861

[21] Appl. No.: 178,352

[22] Filed: Apr. 6, 1988

[51] Int. Cl.[4] ..... B25L 3/00

[52] U.S. Cl. ..... 81/44; 294/65.5

[58] Field of Search ..... 81/44, 23, 24; 248/309.4, 359 G, 359 A, 206.5; 224/253, 904, 183; 269/8; 294/65.5; 227/140, 149

[56] References Cited

U.S. PATENT DOCUMENTS

| | | | |
|---|---|---|---|
| 2,414,653 | 1/1944 | Lookholder | 248/309.4 |
| 2,457,032 | 12/1948 | Case | 248/309.4 |
| 2,664,231 | 12/1953 | La Mantia | 224/253 X |
| 2,723,369 | 11/1955 | Brummett | 294/65.5 X |
| 2,919,086 | 12/1959 | McMahan | 248/206.5 X |
| 3,204,776 | 9/1965 | Brown et al. | 248/309.4 |
| 3,258,237 | 6/1966 | Beiman | 248/309.4 |
| 4,081,114 | 3/1978 | Inoue | 248/309.4 |
| 4,142,714 | 3/1979 | Diepeveen | 269/8 |
| 4,226,105 | 10/1980 | Wehrman | 224/253 X |
| 4,403,725 | 9/1983 | Lawrence | 81/44 X |
| 4,482,049 | 11/1984 | Kot, II | 248/309.4 |
| 4,497,412 | 2/1985 | Labelle | 248/309.4 |
| 4,544,067 | 10/1985 | Miller . | |

*Primary Examiner*—Debra Meislin
*Attorney, Agent, or Firm*—Jerry T. Kearns

[57] ABSTRACT

A magnetic nail holding device has a generally rectangular hollow housing. A pair of overlying jaw elements with magnetic tip portions project from an opening in a front end portion of the housing. One of the jaw members is stationary and the second jaw member is mounted for pivotal movement toward and away from the stationary jaw member. A spring biased push button extends from a top portion of the housing for selectively pivoting the movable jaw member between open and closed positions. This allows the magnetic tip portions of the jaw members to be spaced apart any selected distance within a wide range of movement for accommodating a variety of various standard nail sizes. A metal loop is attached to a back end portion of the housing for engagement with an L-shaped magnetic belt hook. This allows the nail holder to be conveniently carried on the belt of a carpenter or other user. The L-shaped belt hook may also be utilized for carrying key rings and other items.

5 Claims, 3 Drawing Sheets

MAGNETIC NAIL HOLDING DEVICE

BACKGROUND OF THE INVENTION

1. Field of the Invention

The present invention relates to magnetic holding devices, and more particularly pertains to a new and improved magnetic nail holding device and a magnetic belt hook for carrying the nail holder. Individuals frequently smash their fingers while holding a nail and attempting to drive the nail with a hammer. This is a particular problem with smaller nail sizes because the individual's fingers have a large width in relation to the length of the smaller nails. This causes the individual's fingers to extend very near to the nail head, resulting in frequent painful injury to such individuals. Additionally, it is often impossible due to lack of space, for an individual to hold a small nail in a corner or other restricted work area. While various prior art devices have been proposed for the solution of these problems, these devices are bulky and difficult to transport. Additionally, these devices do not adapt for use with a variety of different nail sizes. In order to overcome these problems, the present invention provides a magnetic nail holding device which is adaptable for use with a wide variety of different sizes and lengths of nails and is provided with a magnetic belt attached holder for enabling convenient storage and transportation.

2. Description of the Prior Art

Various types of magnetic holding devices are known in the prior art. A typical example of such a magnetic holding device is to be found in U.S. Pat. 2,414,653, which issued to E. Lookholder on Jan. 21, 1947. This patent discloses a magnetic toothbrush rack which utilizes a U-shaped magnet enclosed within a plastic housing. U.S. Pat. No. 2,457,032, which issued to E. Case on Dec. 21, 1948, discloses a magnetic cutlery rack which utilizes a plurality of spaced magnets secured to a display board. The magnets have a rectangular channel configuration with a rectangular central groove provided with a transversely extending aperture for the reception of a threaded fastener for securing the magnet to the display board. U.S. Pat. No. 3,204,776, which issued to C. Brown et al on Sept. 7, 1965, discloses a magnetic tool board which utilizes a plurality of adjustable shelves in conjunction with a plurality of adjustably positionable magnetic disks for storing a variety of tools in a generally vertical orientation. U.S. Pat. No. 3,258,237, which issued to J. Beiman on June 28, 1966, discloses a peg board provided with selectively positionable wire brackets. Permanent magnets are adhesively secured to the wire brackets for holding various metallic articles. U.S. Pat. No. 4,081,114, which issued to M. Inoue on Mar. 28, 1978, discloses a magnetic support assembly which utilizes a ring shaped permanent magnet for transporting a disc shaped magnetic golf ball marker. The ring shaped magnet has an attached loop for engagement with a supporting cord or with the shoe lace of a golf shoe. U.S. Pat. No. 4,482,049, which issued to N. Kot on Nov. 13, 1984, discloses a magnetic drill holder which includes a housing fabricated as a series of adjoining longitudinal channels with each channel having one closed end. A common magnetic backing plate encloses the channels longitudinally, thus forming longitudinal receptacles. The channels may be of varying lengths and areas, making them suitable for holding a series of tools, such as drill bits. Magnetic tools placed in the receptacles are retained in them by magnetic attraction. U.S. Pat. No. 4,497,412, which issued to E. Labelle on Feb. 5, 1985, discloses a knife holder formed from an elongated rectangular block provided with a series of spaced slots for the reception of knife blades. U.S. Pat. No. 4,544,067, which issued to M. Miller on Oct. 1, 1985, discloses a magnetic tool holder which includes a pair of plates with a magnetic bar sandwiched therebetween. A pair of L-shaped support brackets are riveted to the assembly for mounting the holder on a planar surface.

While the above mentioned devices are suited for their intended usage, none of these devices provide a magnetic nail holder which utilizes adjustable jaw members for holding a wide variety of different lengths and sizes of nails. Additionally, none of the aforesaid magnetic holding devices provides an L-shaped magnetic belt hook suitable for enabling an individual to transport a magnetic nail holder on their belt. Inasmuch as the art is relatively crowded with respect to these various types of magnetic holding devices, it can be appreciated that there is a continuing need for and interest in improvements to such magnetic holding devices, and in this respect, the present invention addresses this need and interest.

SUMMARY OF THE INVENTION

In view of the foregoing disadvantages inherent in the known types of magnetic holding devices now present in the prior art, the present invention provides an improved magnetic nail holding device. As such, the general purpose of the present invention, which will be described subsequently in greater detail, is to provide a new and improved magnetic nail holding device which has all the advantages of the prior art magnetic holding devices and none of the disadvantages.

To attain this, a representative embodiment of the concepts of the present invention is illustrated in the drawings and makes use of a generally rectangular hollow housing. A pair of overlying jaw elements with magnetic tip portions project from an opening in a front end portion of the housing. One of the jaw members is stationary and the second jaw member is mounted for pivotal movement toward and away from the stationary jaw member. A spring biased push button extends from a top portion of the housing for selectively pivoting the movable jaw member between open and closed positions. This allows the magnetic tip portions of the jaw members to be spaced apart any selected distance within a wide range of movement for accommodating a variety of various standard nail sizes. A metal loop is attached to a back end portion of the housing for engagement with an L-shaped magnetic belt hook. This allows the nail holder to be conveniently carried on the belt of a carpenter or other user. The L-shaped belt hook may also be utilized for carrying key rings and other items.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved magnetic nail holding device which has all the advantages of the prior art magnetic holding devices and none of the disadvantages.

It is another object of the present invention to provide a new and improved magnetic nail holding device which may be easily and efficiently manufactured and marketed.

It is a further object of the present invention to provide a new and improved magnetic nail holding device which is of a durable and reliable construction.

An even further object of the present invention is to provide a new and improved magnetic nail holding device which is susceptible of a low cost of manufacture with regard to both material and labor, and which accordingly is then susceptible of low prices of sale to the consuming public, thereby making such magnetic holding devices economically available to the buying public.

Still yet another object of the present invention is to provide a new and improved magnetic nail holding device which provides in the apparatuses and methods of the prior art some of the advantages thereof, while simultaneously overcoming some of the disadvantages normally associated therewith.

Still another object of the present invention is to provide a new and improved magnetic nail holding device which enables individuals to hold and drive a wide variety of different lengths and sizes of nails without injuring their fingers.

Yet another object of the present invention is to provide a new and improved magnetic nail holding device which utilizes a magnetic belt hook for enabling convenient transportation.

Even still another object of the present invention is to provide a new and improved magnetic nail holding device which utilizes a pair of relatively movable magnetic jaw members for holding a wide variety of different length nails.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention Will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
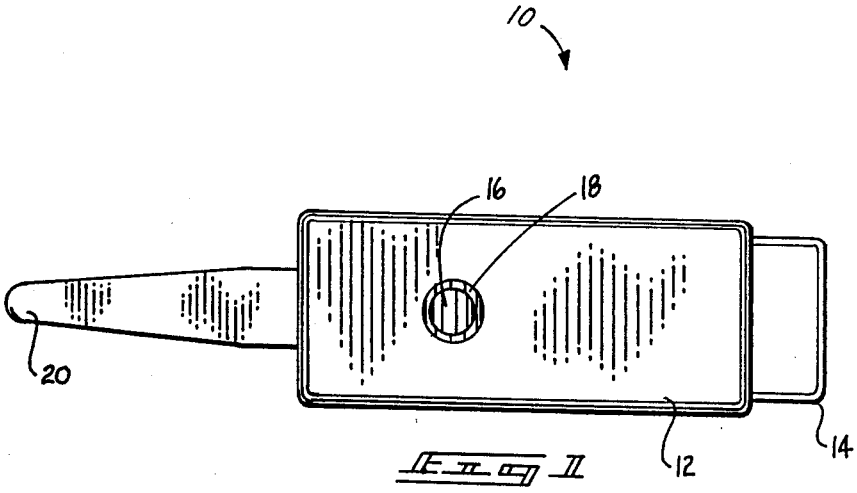
FIG. 1 is a top view of the magnetic nail holding device of the present invention.

With reference now to the drawings, and in particular to FIG. 1 thereof, a new and improved magnetic nail holding device embodying the principles and concepts of the present invention and generally designated by the reference numeral 10 will be described.

More specifically, it will be noted that the first embodiment 10 of the invention includes a hollow generally rectangular housing 12 which may be constructed from a metal or plastic material. A rectangular loop 14 is secured to and extends from a back end portion of the housing 12. An axially movable cylindrical push button 16 extends from an aperture surrounded by a cylindrical boss 18 in a top portion of the housing 12. A pair of relatively movable jaws, the top one 20 of which may be seen in FIG. 1, extend from a front end portion of the housing 12. The tip portions of each of the jaws are radiused and are magnetized or formed from a permanent magnetic material.

Figure 2:
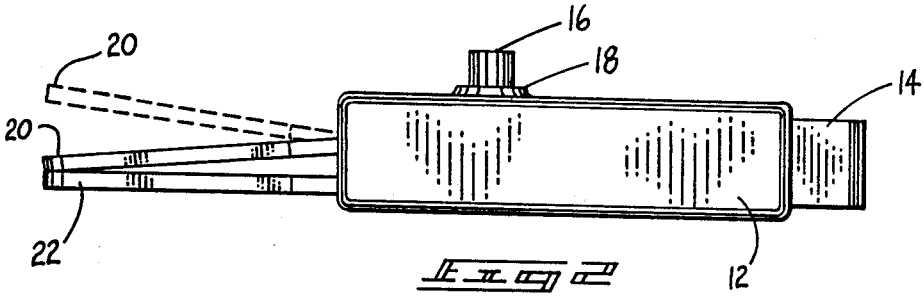
FIG. 2 is a side view of the magnetic nail holding device of the present invention, with the range of movement of the movable jaw member indicated in phantom.

As shown in the side view of FIG. 2, a pair of jaw members 20 and 22 extend from the front end portion of the housing 12, in generally parallel overlying relation. The bottom jaw member 22 is fixed with respect to the housing 12. The upper jaw member 20 is pivotally movable through a range of movement as indicated by the extreme upper position of the jaw 20 illustrated in phantom line. The cylindrical push button 16 extending from the top portion of the housing 12 actuates the movable jaw 20 for movement between open and closed positions by a mechanism to be described subsequently.

Figure 3:
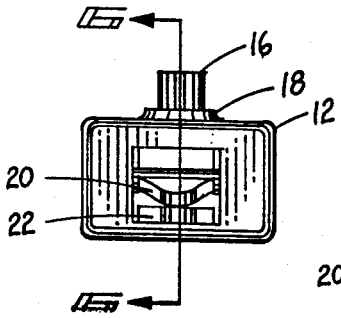
FIG. 3 is a front end view of the magnetic nail holding device of the present invention, with the jaws in a closed position for one with small nails.

In FIG. 3, a front end view of the magnetic nail holder 10 illustrates the movable jaws 20 in a closed position. This is the normal position of the jaws 20 and 22, with the cylindrical push button 16 urged by an external spring to a fully extended position.

Figure 4:
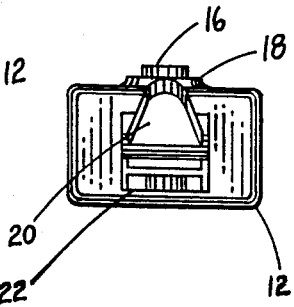
FIG. 4 is a front end view of the magnetic nail holding device of the present invention, with the jaws in an open position for use with long nails.

As shown in FIG. 4, by depressing the push button 16 to a fully depressed position, the movable jaw 20 may be moved to an extreme open position.

Figure 5:
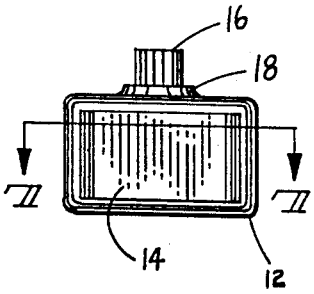
FIG. 5 is a back end view of the magnetic nail holding device of the present invention.

In FIG. 5, a back end view of the nail holder 10 illustrates the rectangular loop 14 which extends therefrom.

Figure 6:
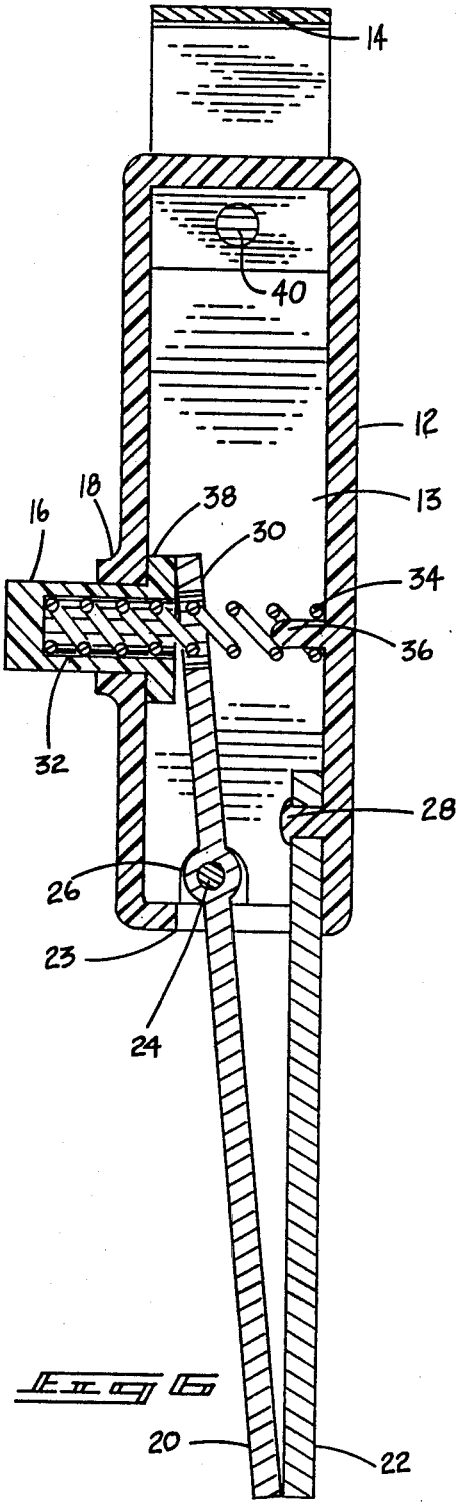
FIG. 6 is a longitudinal cross sectional view, taken along 6—6 of FIG. 3, illustrating the internal jaw moving mechanism of the magnetic nail holder of the present invention.

With reference now to FIG. 6, the operating mechanism for actuating the movable jaw 20 will now be described. A stationary pivot pin 24 extends transversely across a front portion of the housing 12, adjacent a generally rectangular front opening 23. The stationary jaw 22 and movable jaw 20 both extend outwardly from tee housing 12 through the opening 23. The stationary jaw 22 is secured to the bottom interior floor 13 of the housing 12 by a pin 28. A hub portion 26 formed on the movable jaw 20 is received for rotation around the stationary pivot 24. A back end portion of the movable jaw 20 is provided with a circular aperture 30 through which a coil spring 34 extends. The coil spring 34 is received around a locating pin 36 on the bottom interior floor 13 of the housing 12. The cylindrical push button 16 has a cylindrical recess 32 which receives a top end portion of the spring 34. Thus, the coil spring 34 is captured between the locating pin 36 and the push button 16. A radially extending flange 38 is formed on the bottom end o the push button 16. The flange 38 abuts the back end portion of the movable jaw 20 and also serves to prevent the push button 16 from being pushed out through the top wall of the housing 12. As may now be readily understood, by depressing the push button 16 downwardly towards the interior floor 13 of the housing 12, the movable jaw 20 will be pivoted about the pin 24 to an open position. In this position, the movable jaw 20 will be spaced apart from the stationary jaw 22. Upon releasing the push button 16, the weight of the front end of the movable jaw 20 causes the jaw 20 to return to a closed position. By partially depressing the push button 16, the movable jaw 20 may be spaced apart from the stationary jaw 22 to any desired extent within the range of possible movement. In the illustrated closed position, the magnetic ends of the jaws 20 and 22 are ideally positioned for supporting small sizes of nails having a short length. For use with longer nails, the push button 16 is depressed, thus spacing apart the jaws 20 and 22 for providing spaced support along the length of a longer nail. After the tip portions of each of the jaws 20 and 22 are placed into magnetic engagement at spaced locations along the length of a nail, with the tip of the jaw 20 positioned adjacent the nail head, the push button 16 may be released, without disturbing the selected positioning of the jaws 20 and 22. The free floating pivotal mounting of the jaw 20 allows the nail to be driven with a hammer without damage to the nail holder 10, and prevents the force of the hammer blow from being transmitted to the users hand. As the nail is progressively driven, the jaw 20 merely pivots to an increasingly closed position.

Figure 7:
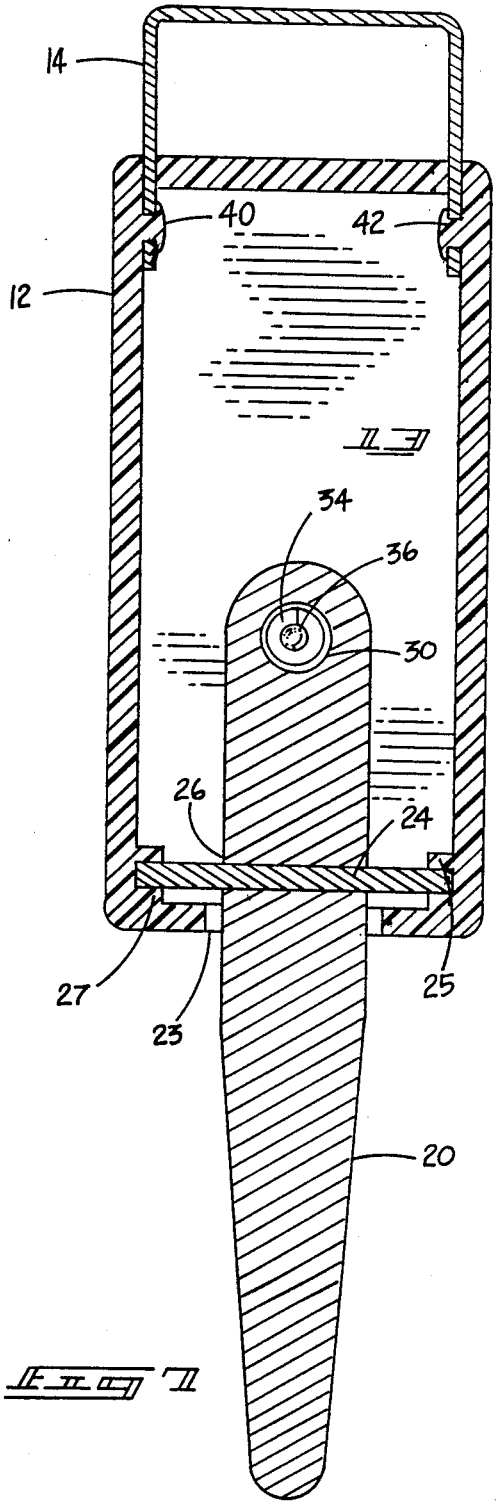
FIG. 7 is a transverse cross sectional view, taken along line 7—7 of FIG. 5, further illustrating the internal construction of the magnetic nail holder of the present invention.
Figure 10:
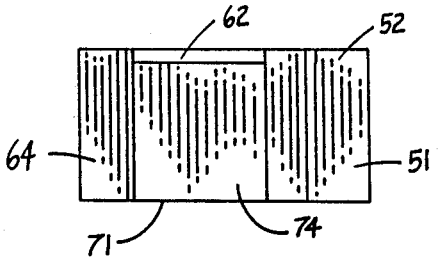
FIG. 10 is an end view of the L-shaped magnetic belt hook of the present invention.

As shown in the transverse cross sectional view of FIG. 7, the rectangular loop 14 is formed from a metallic material and is secured by pins 40 and 42 to the housing 12. The stationary pivot pin 24 extends transversely across a front portion of the housing 12 and is secured by spaced bosses 25 and 27.

Figure 8:
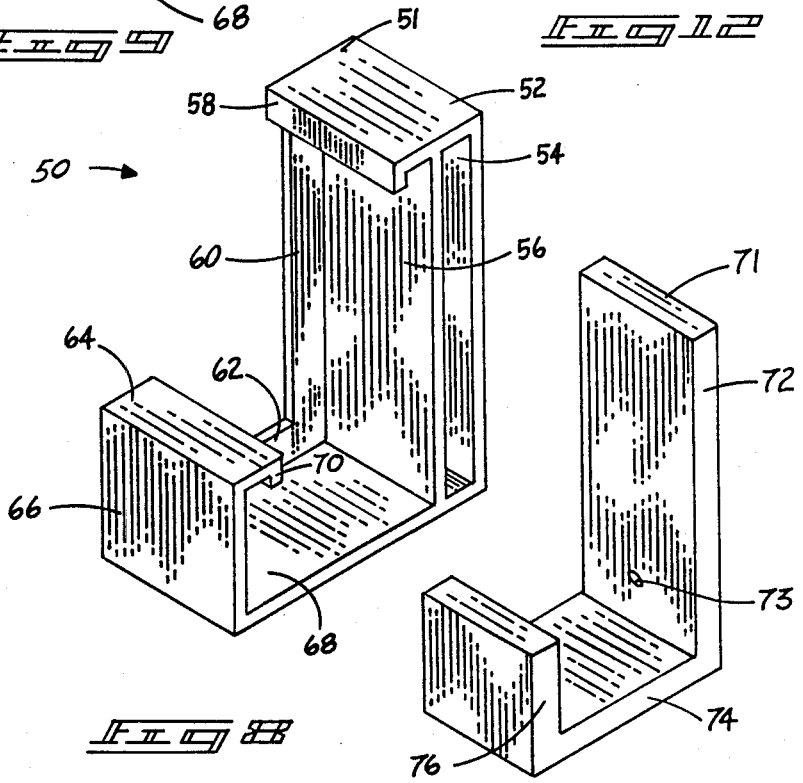
FIG. 8 is an exploded perspective view illustrating the L-shaped magnetic belt hook for transporting the magnetic nail holder of the present invention.

With reference now to FIG. 8, an L-shaped magnetic belt hook for use in transporting the magnetic nail holder 10 of the present invention will now be described. The L-shaped magnetic belt hook 50 includes an L-shaped housing portion 51 which may be formed from a metal or plastic material. The L shaped housing portion has a generally vertically extending short leg portion 66 connected by a generally horizontally extending bottom floor portion 68 to a generally vertically extending long leg portion 56. An elongated rectangular vertically extending slot 54 is formed in the long leg portion 56. The slot 54 is designed for reception around the belt of an individual. A transversely extending top wall 52 is formed integrally with the long leg portion 56. A vertically downwardly extending ledge 58 is formed on the top wall portion 52. A similar horizontally extending top wall portion 64 is integrally formed with the short leg portion 66 and includes a vertically downwardly extending ledge 70. An elongated vertical back ledge wall 60 has an integrally formed short back ledge portion 62. A second short vertical back ledge wall 63 (FIG. 11) extends in the same plane as the walls 60 and 62. A generally L-shaped magnet 71 having a long vertical leg portion 72 formed integrally with a short bottom horizontally extending leg portion 74 and a vertically extending short side wall 76 is dimensioned to be received in close fitting frictional engagement within the housing 51. A cylindrical aperture 73 is formed in the magnet 71 through the elongated vertical wall 72 for purposes of receiving a pin to be utilized in removing the magnet from the housing.

Figure 9:
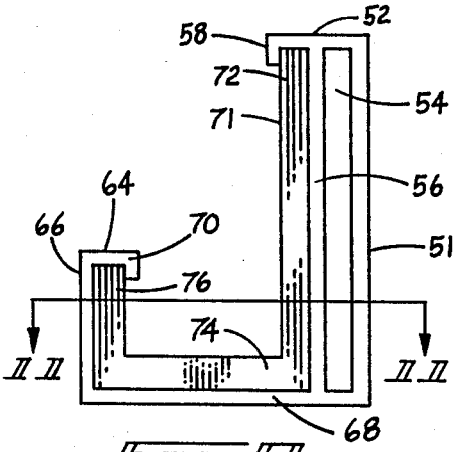
FIG. 9 is a side view of the L-shaped magnetic belt hook of the present invention.

With reference now to FIG. 9, a side view of the generally L-shaped magnetic belt hook illustrates the magnet 71 received in secure frictional engagement within the housing 51. The vertically downwardly extending ledges 70 and 58 frictionally engage the long 72 and short 76 vertical leg portions of the magnet. In use, an individual threads their belt through the loop 54, thus securing the holder 50. The rectangular loop 14 on the nail holder 10 is then placed over the short vertical leg portion 66 and into engagement with the horizontal magnetic floor portion 74. The short vertically extending magnetic wall portion 76 and ledge 70 prevent the nail holder 10 from being accidentally dislodged. In addition to holding the nail holder 10, various other metallic articles such as key rings may be carried.

Figure 11:
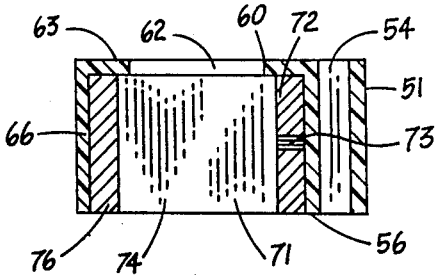
FIG. 11 is a transverse cross sectional view, taken along line 11—11 of FIG. 9, illustrating the construction of the L-shaped magnetic belt hook of the present invention.

In FIG. 11, a transverse cross sectional view, taken along line 11—11 of FIG. 9, illustrates the assembled relation of the magnet 71 within the housing 51. The back wall portions 60, 62 and 63 prevent the magnet 71 from being dislodged from the housing 51.

Figure 12:
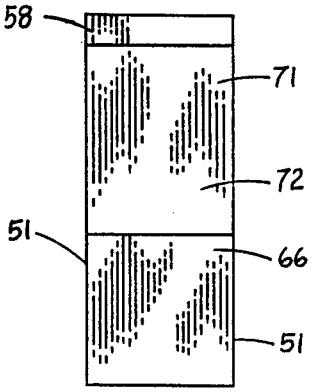
FIG. 12 is a front view of the L-shaped magnetic belt hook of the present invention.

In FIG. 12, a front view of the assembled housing 51 and magnet 71 is provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A magnetic nail holding device, comprising:

a housing;

a pair of relatively movable elongated jaws extending in generally parallel overlying relation from said housing;

one of said elongated jaws being stationary and fixed to said housing and the other of said jaws being a movable jaw pivotally mounted in said housing;

said movable jaw having a hub portion;

a pivot pin extending through said hub portion and secured to said housing;

each of said jaws having a magnetic tip portion;

a push button extending through a top portion of said housing and having a bottom end abutting an inner end of said movable jaw for selectively moving said movable jaw to an open position and for allowing said movable jaw to return to a closed position; and means on said housing for securing said housing on a belt of a user.

2. The magnetic nail holding device of claim 1, further comprising a radially extending annular ledge formed on said bottom end of said push button.

3. The magnetic nail holding device of claim 2, further comprising:

a circular aperture formed through said inner end of said movable jaw;

a retaining pin extending upwardly from an interior floor of said housing;

a cylindrical recess in said push button; and a coil spring extending through said circular movable jaw aperture and into said cylindrical recess, said coil spring captured between said push button and said retaining pin.

4. The magnetic nail holding device of claim 1, wherein said means for carrying said housing on a belt of a user comprises metallic loop means on said housing and magnetic hook means having an elongated slot for receiving a belt of an individual user.

5. The magnetic nail holding device of claim 4, wherein said magnetic hook means further comprises:

a generally L-shaped housing:

said elongated belt-receiving slot formed in said L-shaped housing; and a generally L-shaped magnet retained by frictional engagement in said L-shaped housing.

* * * * *